US005809922A

United States Patent [19]

Nelson

[11] Patent Number: 5,809,922

[45] Date of Patent: Sep. 22, 1998

[54] TRANSPORTATION OF SUBMERGED CARGO

[76] Inventor: Arthur J. Nelson, 700 Laurel Ave. 6A1, San Mateo, Calif. 94401

[21] Appl. No.: 723,534

[22] Filed: Sep. 30, 1996

[51] Int. Cl.[6] ..... B63B 35/30

[52] U.S. Cl. ..... 114/73; 114/73

[58] Field of Search ..... 114/73, 36, 37

[56] References Cited

U.S. PATENT DOCUMENTS 1,442,055 1/1923 Dunbar ..... 114/36

FOREIGN PATENT DOCUMENTS 564795 2/1958 Belgium ..... 114/36

*Primary Examiner*—Jesus D. Sotelo

[57] ABSTRACT

A shipshaped vessel adapted to transport cargo, in an arrangement: to retard free fall of slurry kind cargo loading pivotally mounted clamshell bucket halves, to transport slurry in clamshell buckets immersed below sea surface, to moor above a ballast-ladened dock immersed at a terminal, to angularly open clamshell halves to discharge slurry upon porous hoppers atop the lock, with the vessel departed deballast the dock to buoyantly surface hoppers to drain off water, to remotely open hopper bottomed gate valves to selectively load conveyor belts for cargo discharge into terminal hopper.

1 Claim, 10 Drawing Sheets

10
10a
10b
13
14
14'
17
32a
40
40
50
52
11b
11a
16p
D
T1
T2

10
12
13
17
18
19
40
50
16p
11a
B
L

FIG 9a
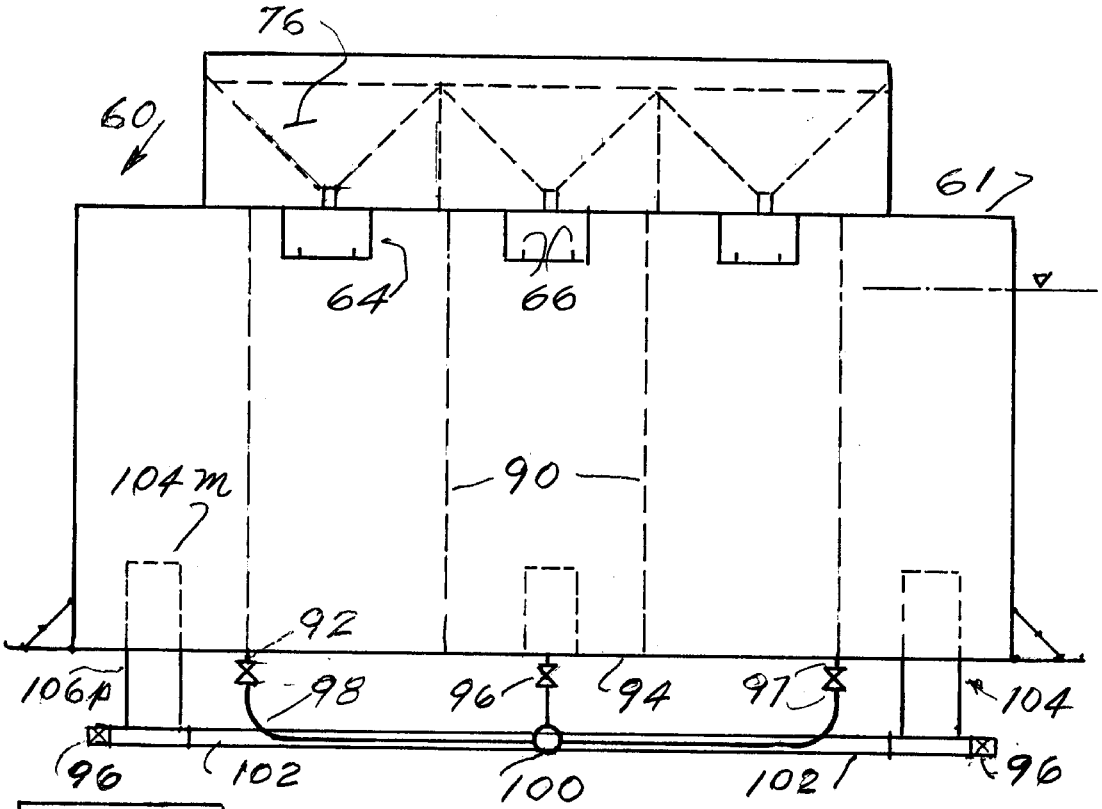
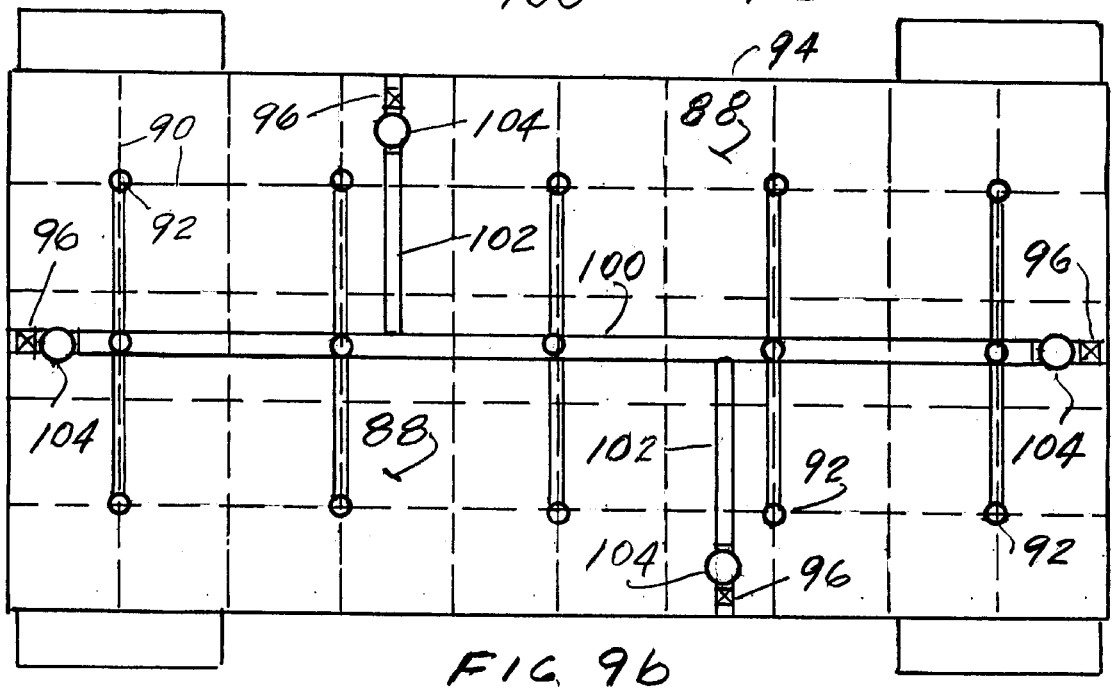
FIG 9b

TRANSPORTATION OF SUBMERGED CARGO

BACKGROUND OF THE INVENTION

1. Field of the Invention

Transportation of bulk cargo of interest relates to its handling as a slurry to load a vessel and discharge the cargo at a terminal as the intermediary completed transportation stage for further development or use.

2. Description of the Prior Art

Conventional loading of the hopper dredger, examples with a freighter, the contention to evacuate surfaced water above the contained slurry to optimize load by solids contained. Then must be resolved how to unload the slurry for recovery of solids that may be gravel, iron pellets as example of values to process into structures, apparatus, etc.

It is the lack of efficient systems to transport bulk cargo, as a maritime segment in forwarding cargo, that has hindered reality of much needed developments.

SUMMARY

Advantages and objects of the invention relate to annualized marine transportation of vast tonnages of bulk cargo kinds, classified as insoluble, non-porous and impervious to sea workings, exemplified by gravel as delineated: solid rock (granite) weight=165#/ft$^3$; nonclassified mined gravel from sea floor wt.=115#/ft$^3$; sea water wt.=64#/ft$^3$; void inherent with gravel is 165−115/115=0.4348 of gravel volume; immersed weight of clamshell contained gravel is 165−64/165=0.6121 of water surfaced gravel weight.

A shipshaped vessel, fitted with a pivotally mounted and suitably contained semi-cylindrical clamshell bucket gravel carrier, has a loaded draft sufficient to immerse said gravel displacing sea water, to lessen the load on the vessel with residual buoyancy as augmented by buoyancy developed by the immersed bucket.

Pivotal mounting of clamshell bucket serves to angularly peel open bucket two halves to discharge gravel through a slotted opening in the vessel bottom, into hoppers atop an immersed dock centrally disposed beneath said vessel moored at a terminal.

Arrangements between the water surfaced dock and terminal provides for conventional rubber belt conveyor systems to transfer hopper load of gravel to terminal hopper feed of gravel as a completed transportation operation.

Terminal effected provisions suit a buoyant dock responses to load and tidal change, non-uniform loading of hoppers and monitoring of control means for a level dock.

BRIEF DESCRIPTION OF DRAWINGS

FIG. 9*a*. End elevational view of a dock.

FIG. 9*b*. Plan view of dock hold partitioning and ballast piping arrangement.

DESCRIPTION OF THE PREFERRED EMBODIMENT

Figure 1:
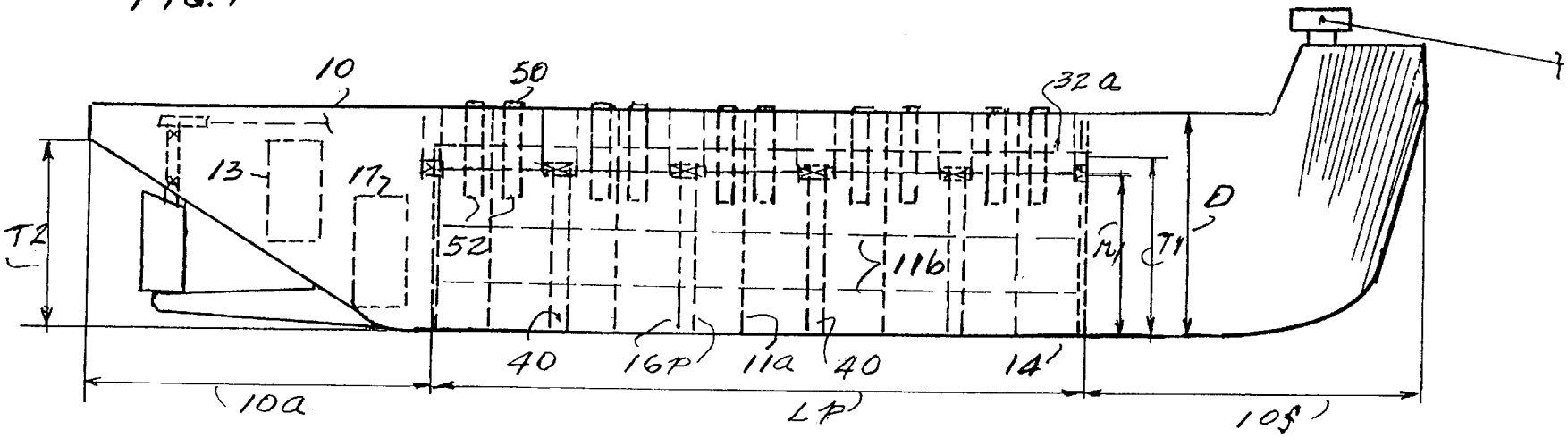
FIG. 1. Side elevational outline of vessel (10).
Figure 3:
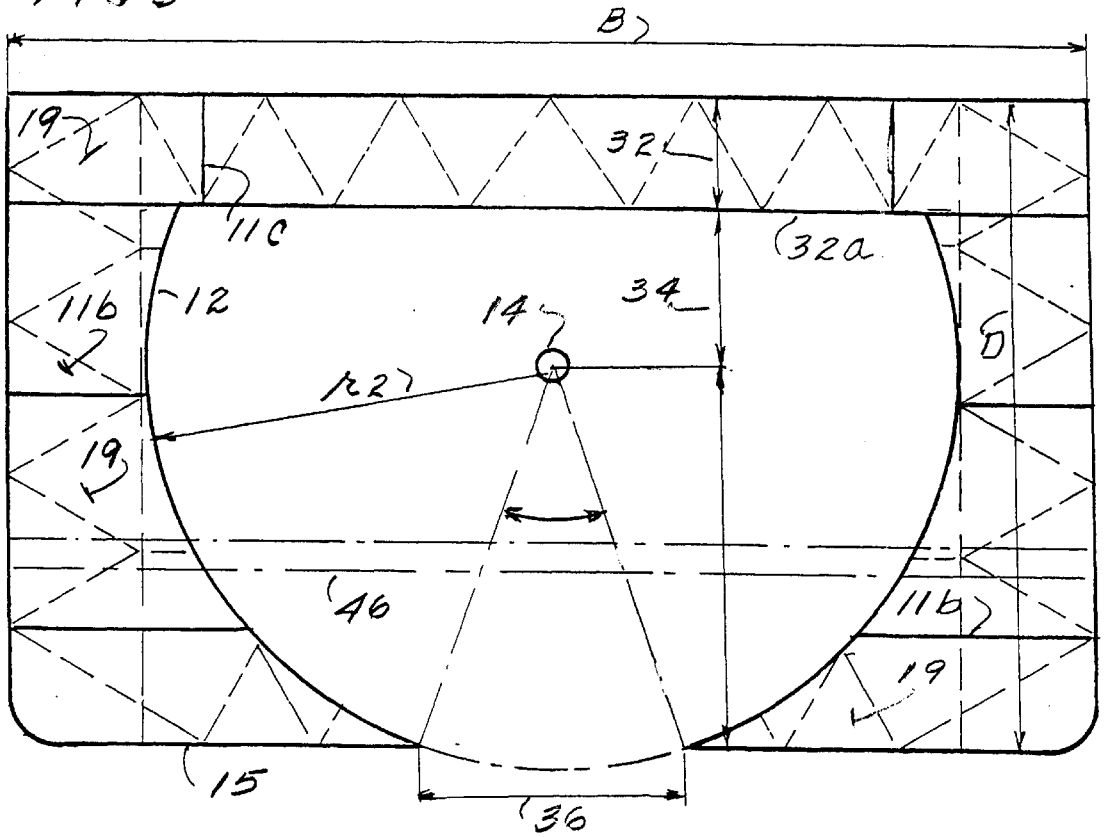
FIG. 3. Mid-length and sectional view of hollowed-out vessel hull.

A vessel (10) (FIG. 1) of a fleet proposed, is shipshaped, unmanned, directionally stable with rudder linked to the towline, as pull propelled to haul bulk cargo contained as a slurry, with cargo classification being: insoluble, non-porous, and impervious to sea workings, typified by iron pellets and gravel, furthermore inclusively termed gravel; wherefore, said vessel is built with a hollowed-out mid-body (12) with length measure ($L_p$) and end view (FIG. 3) detailing its semi-cylindrical form.

More detailed (FIG. 4) shows form (12) scribed from a common axis (14) to radius $r_2$ and, with gap (40*a*) juxtaposed contained in form (12) is a semi-cylindrical clamshell bucket (16) carrier of gravel with outer shell (18) scribed to radius $r_1$ from axis (14); again, common axis (14) locates the pivotal hinge (20) (6*a, b*) interface mounting of clamshell bucket halves (16). Also from said common axis (14) is scribed to radius $r_0$ the inner clamshell gravel bearing surface (22).

Figure 4:
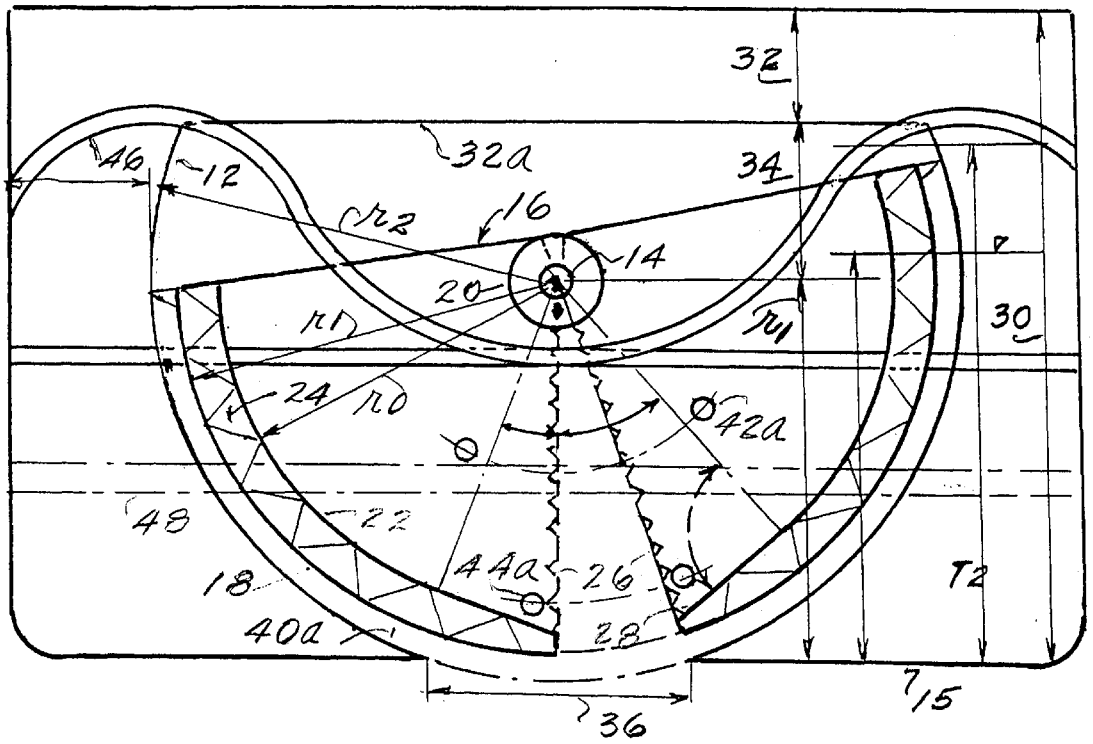
FIG. 4. End elevational view of a semi-cylindrical clamshell bucket disposed in said hollowed-out body.

With symmetry of the port and starboard sides about the vessel 10 vertical longitudinal, FIG. 4 discloses both a perceivable clamped together arranged clamshell bucket to one side and to the other sides a spread-apart halves of the bucket to discharge gravel through the slotted opening (36) in the vessel bottom keel plate (15).

Radii difference ($r_1$−$r_0$) is pertinent to measurements of a void (24) from semi-cylindrical dual surfaced clamshell bucket, for buoyancy to supplement the residual buoyancy of the hollowed out vessel (10). Said radii difference vanishes from flattened surface (28) scribed tangential with arc curve to radius ($r_0$). Opened clamshell halves dispose said flattened surface to angle 36° with the horizontal, as freeing surfaces to self-unload gravel; having gravel angle of repose lessened with rush of water containment in gravel voids with flow as a slurry.

Serrated abutment (26), of immersed clamshell halves locked together, have gap fineness to prevent loss of gravel but free passage of water through voids, measurable 43% of contained gravel, water seeking a common level with seas.

The vessel depth (30) leaves a suitable deck depth (32) remaining with the height (34) above axis (14) providing clearance to 18° arc opening of the clamshell. Deep deck (32*a*) accommodates wide distribution and cross-bracing of supporting girders (46) loaded by gravel weight lessened from immersion to displaced sea water.

In (FIG. 3) the slot width (36), from scribed radius $r_2$ dual intersecting of vessel bottom plate (15), is thus opening to discharge gravel. Fully loaded buckets settle the vessel to draft measure (38) greater than $r_1$ which defines the vessel hull bottom (15), consequently axis (14) is immersed.

Specific gravity differences, between gravel and sea water, yields an immersed gravel weight of 0.61212 of surfaced gravel dead weight.

Slurry is the concept with load position change as a mix of gravel and sea water; only gravel is the load weight borne by the vessel, lessened by displaced sea water weight.

Hollowed out hull resistance, to haul an immersed load of gravel, adds insignificantly to fuel cost increase when measured with lessened fleet voyages to satisfy contracts.

Figure 2:
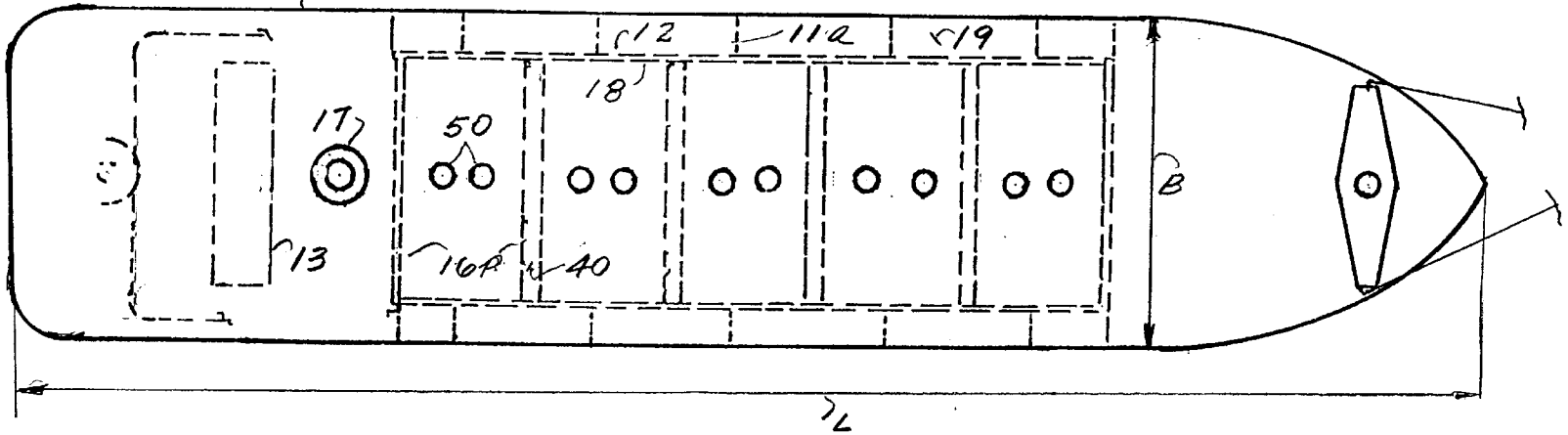
FIG. 2. Plan view of vessel (10).
Figure 5:
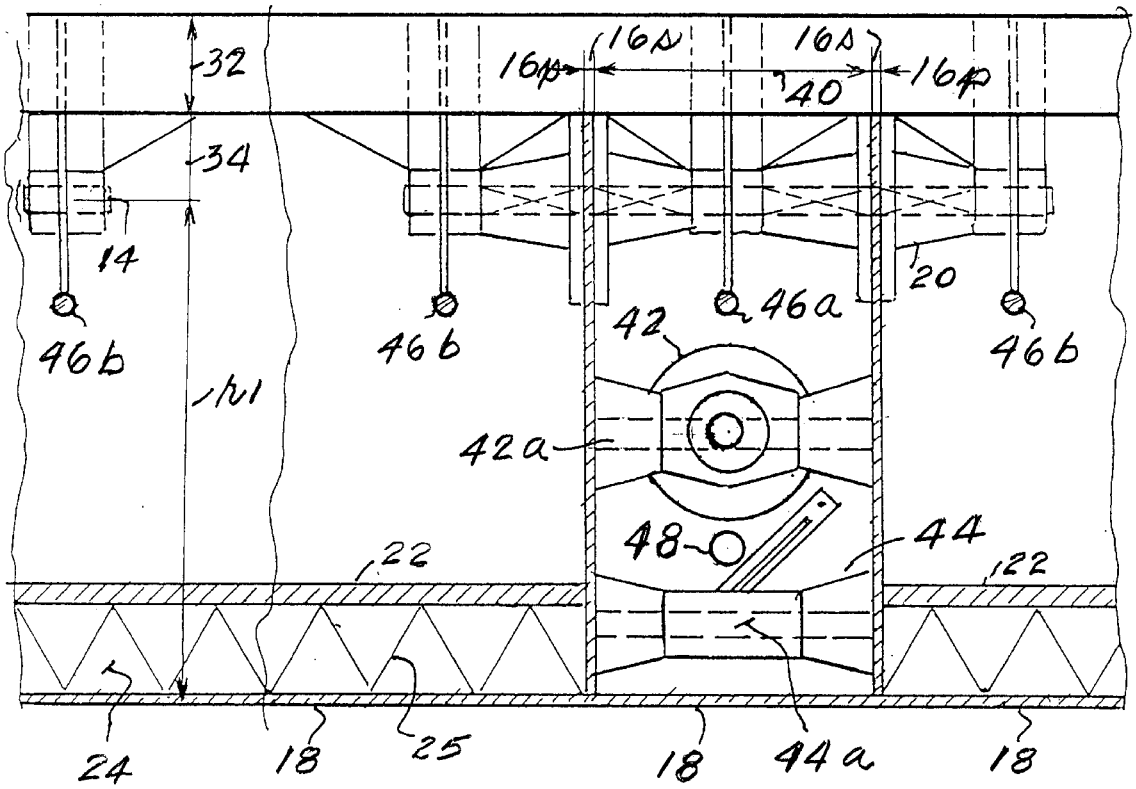
FIG. 5. Side elevational perspective of spaced apart bucket portions.
Figure 6A:
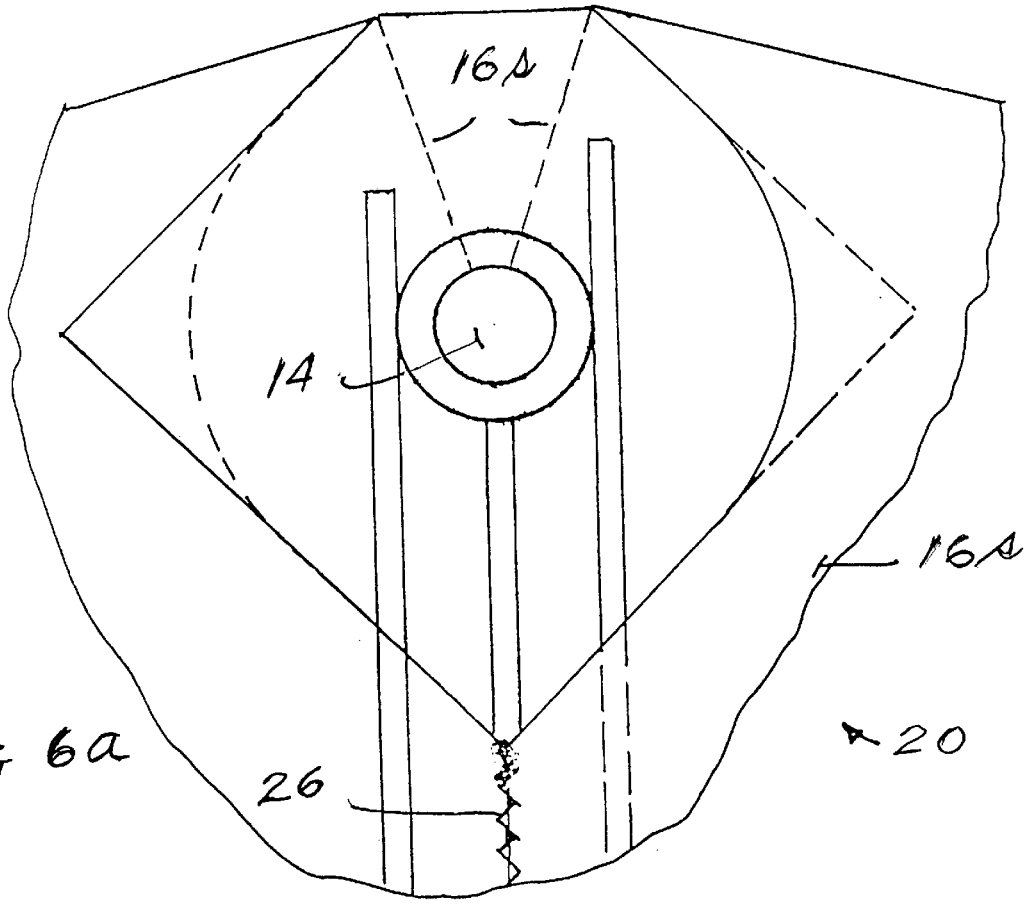
FIG. 6*a*. End elevational view of hinge means for clamshell bucket halves.
Figure 6B:
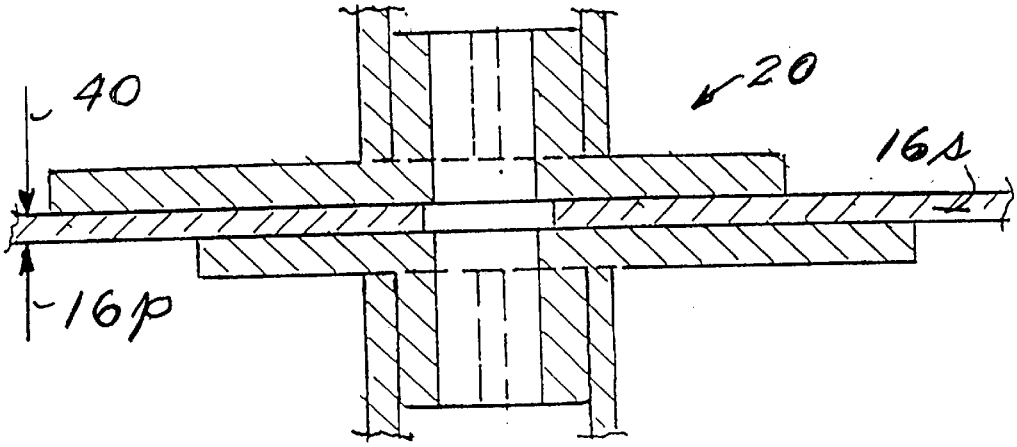
FIG. 6*b*. Sectional plan view of bucket hinge.
Figure 7:
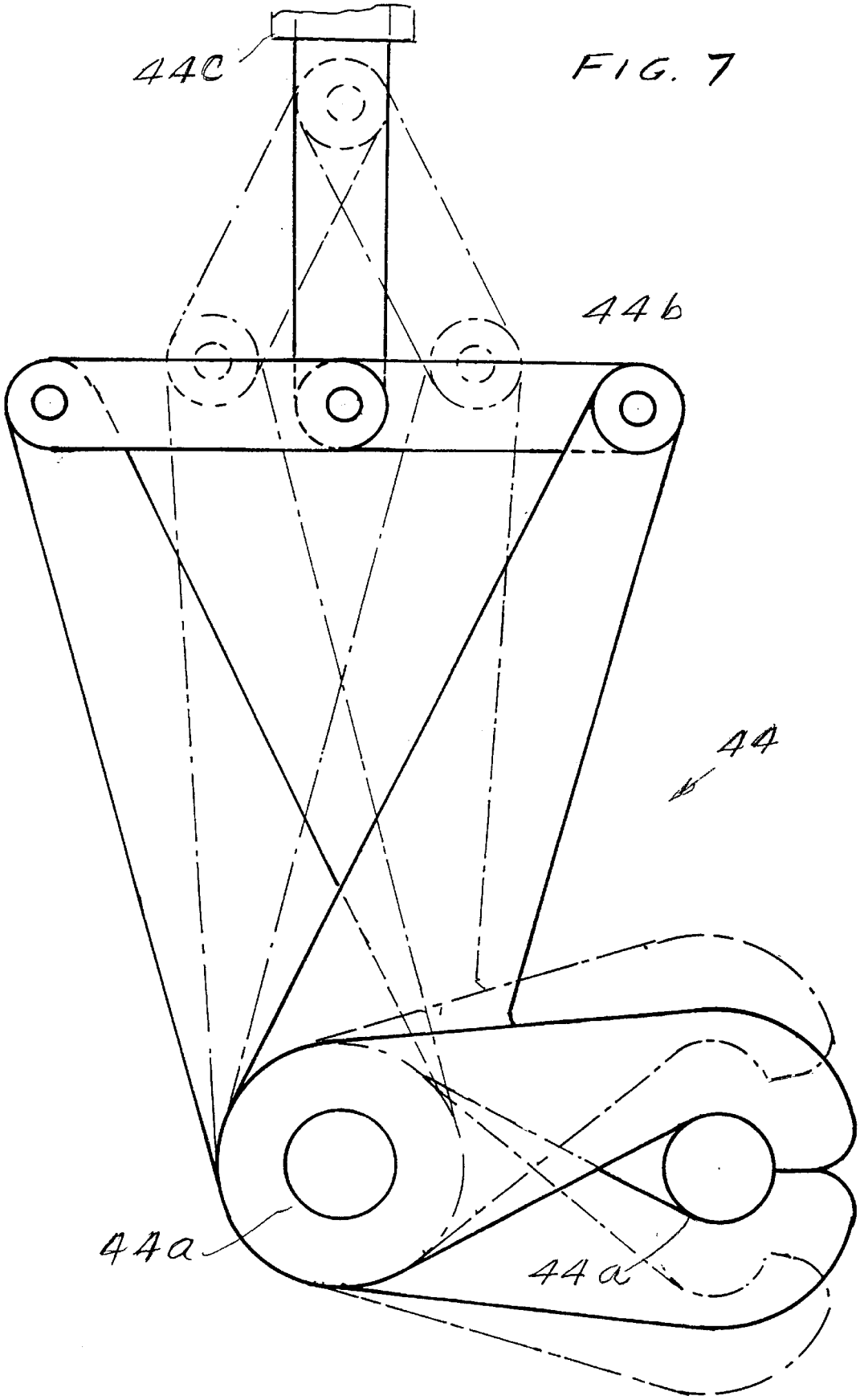
FIG. 7. Elevational outline of clamshell halves' lock.
Figure 12:
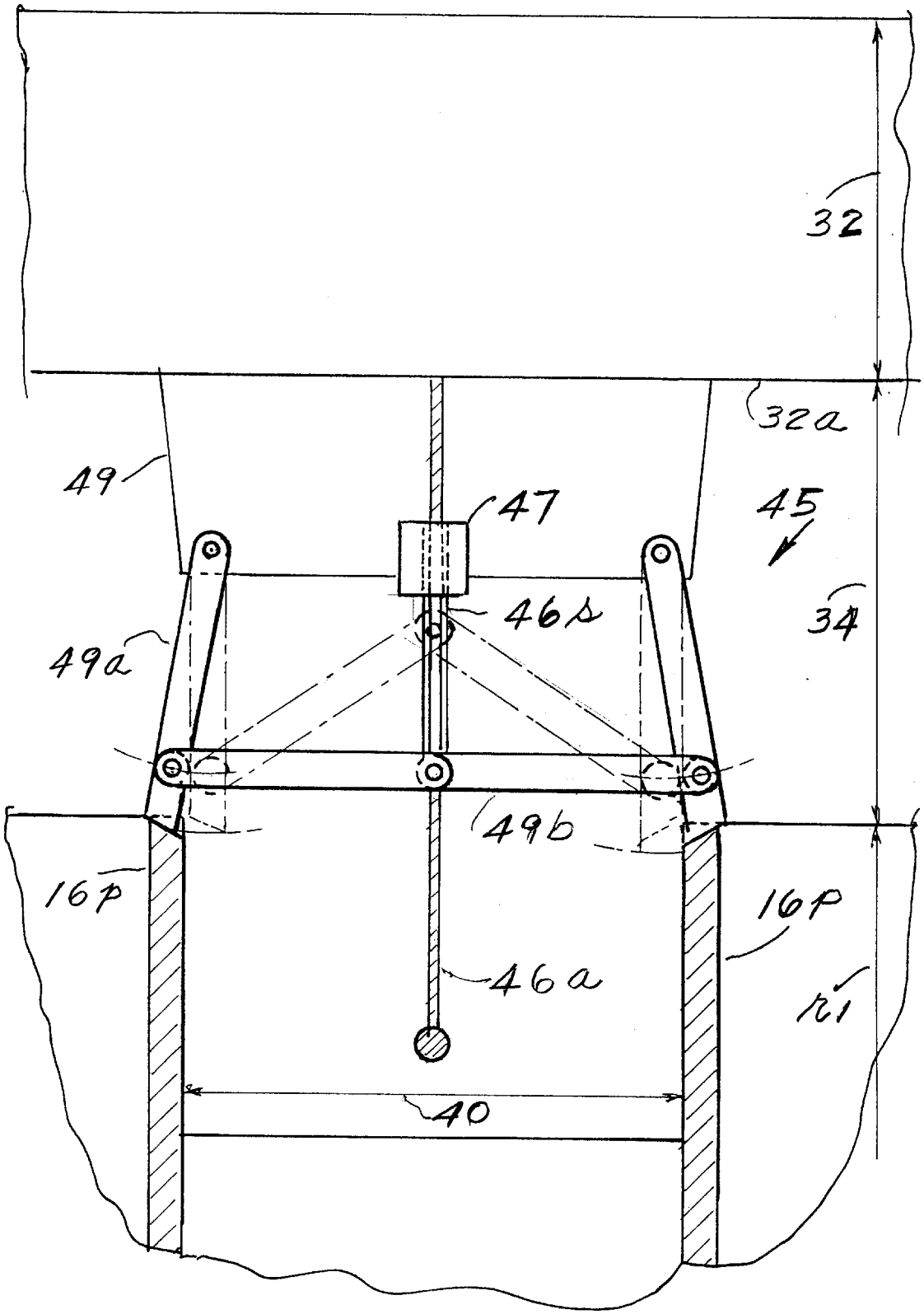
FIG. 12. Diagram to remove sway by the bucket.

The unitized elongated semi-cylindrical clamshell bucket (16) fitting within said hollowed length (Lp) of (FIGS. 1, 2), is a weldment of a completely outfitted assembly (FIG. 5), a repeating sectional view, comprising hinge mounted structure (20), (FIGS. 6*a, b*), selectively five separately built buckets (16*p*), as spaced apart (40). Space 40 serves to contain: a hydraulic cylinder (42) with pins 42*a* providing hinged angular motion for clamshell opening, lowermost contained locking means (44) with pins 44*a* (FIG. 7) against inadvertent clamshell opening, main supporting girders (46) (FIG. 5), pipe strongbacks (48) (FIG. 3), and steady-rest (45) (FIG. 12) at adjacent corners of spaced apart bucket portions; with said deep deck and hull scantlings to amend having slotted the vessel bottom.

Said spacing (40) serves means to more widely distribute loads, lessen bending stress in members, and simplify building to jig and fixture precision, to effect pivotal mounting each component as modular practiced.

Void (24) accommodates enclosure of bracing (25) (FIG. 5) for said dual surfaces (18, 22), from lessened span with the partitioned bucket for a retained bucket shape under load.

Plan view (FIG. 2) of vessel (10) reveals hatch covers (50) representative of dual hatchways for each fifth portioned clamshell bucket. Each hatchway is fitted with a spout (52) (FIG. 8) to interrupt free fall of slurry, by intercepting sloping shelves (54); shelves feeding slurry through ports (56). Ports (56) are arranged spaced apart vertically and angularly to widely broadcast gravel for a uniformly distributed load to the integral and portioned clamshell bucket.

The loaded vessel (10) destination is to a coastwise terminal (58) (FIG. 10), sited with a cove to harbor an elongated floating dock (60); lengthwise stayed from the terminal concreted face for vertical immersion, as ballasted to immerse or elevated upon pump ejection of ballast water. Clamshell buckets (16) peel open to load porous hoppers (76) (FIG. 9*a*) cresting the immersed dock (60).

The immersed dock deck-area (61) mirrors vessel (10) moored directly above (FIG. 10), typically sternwise approaching a terminal, depending upon rubrails as fenders (59) for a vertical alignment of longitudinals. Valves and pumps (FIGS. 9*a, b*), with pipe lacing watertight dock chambers (88), are monitored to automatically maintain a selected dock (60) elevation and level deck (61) with the terminal graded area (62) (FIG. 11), in contention with dock load changes and tidal variation.

End-wise, portion of the dock deck (61) is divided into thirds (FIG. 9*a*). Below deck the center of each third part centers a full length steel enclosing tunnel (64) with an open end facing the terminal. Each tunnel (64) is fitted with track rails (66) that align with a like set of rails borne by a bridge (68) erected from the terminal grade area (62). An apron (70) with rails, hinged to the bridge (68), depends upon the dock for end support.

The dock deck (61) said thirds centers hoppers, surrounded by a bulwark (74), hoppers (76) self-feeding gravel to center fixed gates, remotely opened to feed gravel on to conveyors (72) in said tunnels. Immersed porous hoppers filled with slurry, when surfaced above water rapidly sheds sea water to self-feed only wetted gravel to conveyors.

Typical rubber belt conveyor assemblies (72) (FIG. 11), mounted on wheels to run on said rails, are powered off the dock to said bridge before the dock is submerged. Operated conveyors on the dock discharge gravel into chutes as otherwise handled thus satisfying a transportation contract.

Figures 8A, 8B, 8C, 8D:
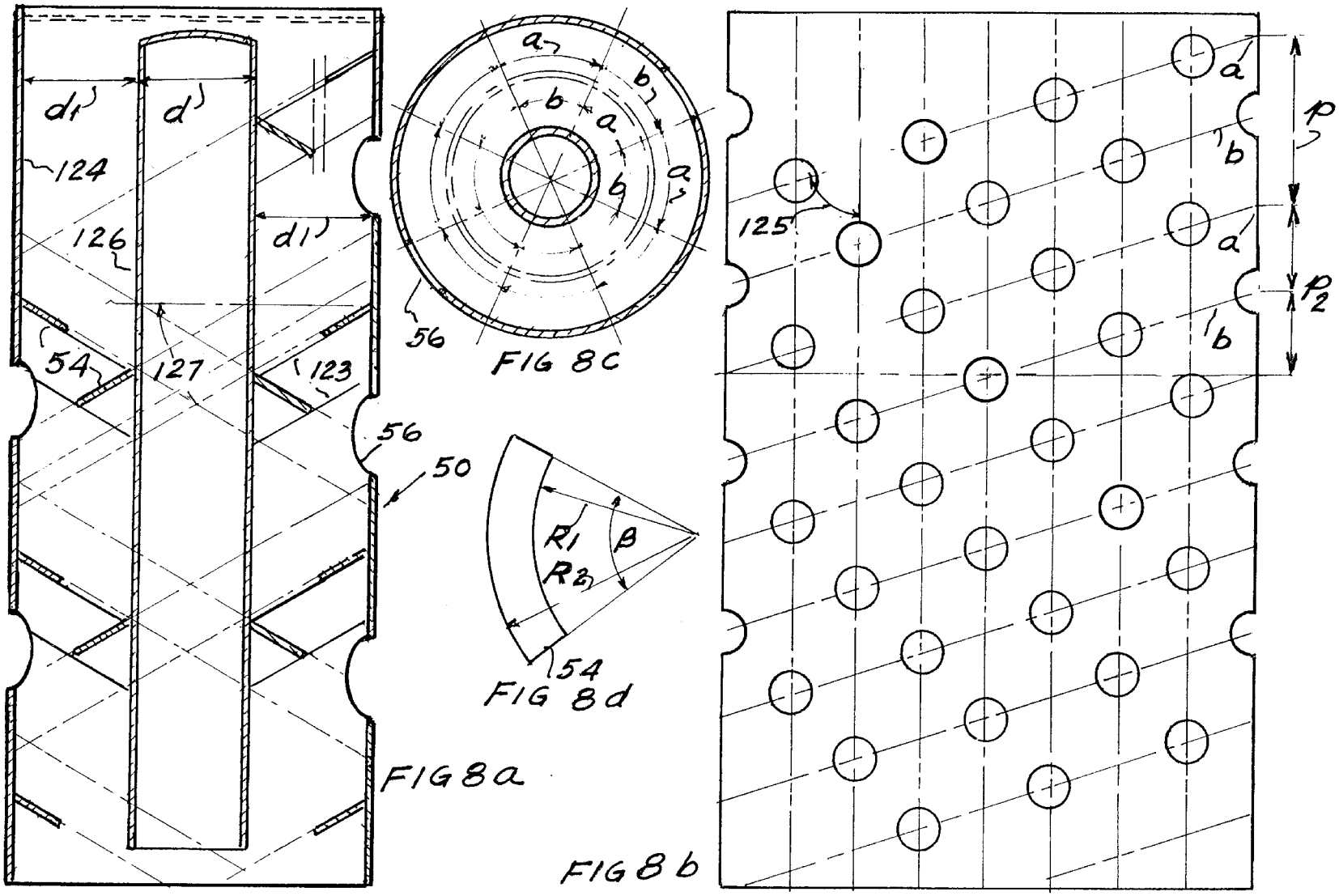
FIG. 8*a*. Elevational sectional view of a spout.
FIG. 8*b*. Serial arrangement of ports in a spout.
FIG. 8*c*. Plan end view of spout with shelves.
FIG. 8*d*. Diagram of circular arc sector.

Detailing to effect operations:

a.) The spout (52) (FIG. 8*a*) outer pipe, fixed to the deck openings (FIG. 2), termed coaming pipe (124), extends selectively long to continue a helix wrap perception of spaced apart descending series, of circular arc sectors (FIG. 8*d*). A core inner pipe (126) with diameter (d) is similarly, but counter helix rotated, wrapped with circular arc sectors; sector with pipe (126) having an inner radius ($R_1 \leqq d$) and outer radius $R_2$ a contingency to establish width of sectors serving as shelves (54).

Sectors are cut from plate with sector arc angles β. As shelves (54), flat sectors wrap meshed with welding to piping, having a slope (125) to vertical axis y'–y" (FIG. 7*b*); deviating inconsequentially from helix path locating the leading upper edge of spaced apart sector weld fixed to piping. With said meshing, segments assume a slant (127) to horizontal axis x'–x" (FIG. 7*a*); suiting an erratic path in decent of slurry, with horizontal component directed both towards and away from the core pipe (126) for in large part trajecting slurry through ports (56) in coaming pipe (124), impeding velocity increase with fall.

The coaming pipe (124) has a diameter ($D_c \geqq 3d$) and sectors for pipe (124) have an outer radius ($R_2 \leqq 3d$). The formed annulus by coaming and core pipe has a least width ($d_1$) as portioned making the shelf width fixed to the core piping (126) greater than coaming pipe (124) fixed shelf.

At a half pitch ρ/2 of scribed helices (a), spout (52) two pipes each have a lower parallel scribed helix (b), with similarly serially spaced apart weld fix sectors, disposed in stagger positions with upper spaced apart sectors. Preassembled pipes (126), with sectors as shelves (54), fit within preassembled pipe (124) by allowed gap between width of shelves, whereupon brackets (123) are fixed by reach through ports 56 to join two pipes.

Pour of slurry into spouts 52 rebounds from coaming pipe shelves to core pipe fixed shelves for rebound with discharge trajectory through openings (56) in coaming pipe 124. A perspective (FIG. 8*b*) of opened coaming pipe circumference examples the lowering step arranged openings (56).

b.) The ballast control arrangement depends on extensive partitioning of the hold of dock (60) (FIG. 9*b*) by numerous bulkheads (90), exampled as forming fifty identical chambers (88). Collected as clusters of chambers (88), having a common bulkhead (90) separating at least two chambers, the junction (92), of bulkheads effecting said cluster of chambers, center a hole cut in the dock bottom plate (94) and removal of sufficient bulkhead juncture wall for free flow of ballast water between said hole and clustered chambers.

A valve (96) (FIG. 9*a*), with bolted on pair of welding neck flanges (97), is welded at the hole to and below the dock bottom plate (94) and with other flange welded to a steel long radius elbow (98) oriented to the dock longitudinal centerline. A main pipeline (100), extending along said centerline, is pipe manifold connected with each elbow (98) for all clusters of chambers (88).

Two branch pipes (102), with and from opposite sides of said main pipe (100), extend with flanged end connected to the inlet of a vertical shaft, unit assembly (104) of a pump (104*p*) below the dock bottom plate (94) and encapsulated motor (104*m*) in the end chamber (88) above. Flanged ends of said main pipe (100), extending to the dock end chambers, are similarly connected to the inlet of identical unit assemblies (104).

Pumps discharge water ballast through flange mounted gate valves to seas; with reverse flow through opening of all said valves to add water ballast as weight to the dock, head of surfaced water providing energy to selectively fill voids in dock vented holds.

Watertight covered access holes, in the dock deck (61) above unit assemblies (104), when opened admit a crane hook to remove disassembled portions of assemble (104). Said valves (96) are lever operated quick opening gate valves actuated by conventional hydraulic thrusters (106) remotely controlled.

The preferred exterior water ballast piping arrangement adds more stability to dock (60) from greater depth of mass and symmetrical arrangement of projecting surfaces opposing motion. Said chambers (88) contain trusses spaced in support of longitudinal framing of the dock (60), with trusses being strengthened by baffles made rigid, to surround reduced areas of free water surface, to lessen potential surge of ballast water from a disrupted calm at said cove, causing the dock to pitch and roll.

c.) Wire system (82) (FIG. 11), pulling conveyors (72) on/off the dock (60), depend upon grade area (62) anchored powered drum (84) and tunnel end mounted sheave (86) to span wires, intermittently supported, with one wire of the two wire strands extending, parted to connect wire parted ends to two ends of conveyors (72), for pulling force with directional travel. Extended conveyor lengths are assemblies of framing members pin connected equal length segments on wheels. Two wire strands, extending from said sheave (86) to the tunnel (64) face, as fitted, are parted to dispose two companion ends draped (82*a*) to tunnel wall and companion other strands draped to the conveyor, o disengage wire system 82 with the docks immersed.

d.) Before conveyors (72) (FIG. 11), free of gravel load, are withdrawn from dock (60) and parked on bridge (68) for the dock to submerge, dock (60) is raised to make rails (66) a level run, dock to bridge. Noting then apron (70) hinge axes (78), with regular position reflex angularity at the bridge support, is lower, by actual rail member sectional depth, than axis (80) with regular positioned obtuse angularity at the dock. Axis 80 centers either a ball joint or hinge mounting of the apron to the dock. Rails at axis (80) are supplemented by welded-on side bars for wheel rims to ride with, while wheel treads breach the gap in rails.

e.) Numerous gates, feeding gravel on rubber belts (72) for three long conveyors, preclude use of conventional skirt boards; so demand load on belts are less than a third of belt ratings, compensating also for instability of conveyor mounting on rails with the buoyant dock, and apron (70) end hinged to said bridge (68).

f.) Roughened cove waters, causing the dock (60) (FIG. 11) to unduly roll, demands a change in apron (70) mounting; the hoist (71) with said grade area (62) then supporting all of the disengaged apron (70) weight with the dock submerged; and, to remove pins effecting bridge end hinged (78) apron support, for relocating of pins in axis 80, ball joint (80) made disabled, for hinge mounting the apron to the dock (60).

The remaining apron (70) end support (FIG. 11*b*) by hoist (71) is with bridle (83) looped in fit with a circular thimble (85), and depends upon the accommodating thimble (85) shift in bearing with the hoist hook, from bridle leg (85) length differences, as a rigid apron structure twists with each dock roll.

g.) (FIG. 11) details the water surfaced dock (60) bearing against cornering, spring loaded struts (108), projecting from the terminal concreted face; dock tied in place by a tensioned wire system (109), as paired, incorporating tensiometers (110) anchored on the grade area (62). Sheave (112) shackled to dock corners for steel wire reeving therefrom extending one end to powered drums (114).

The wire other end from said sheave connects with a length of nylon rope (116) extending with fix to the tensiometer (110). Nylon rope resilience copes with horizontal component length differences of said apron (70) angular conformance, with tidal and load changing the dock (60) elevation with said grade area (62).

Increased tension indicated at one tensiometer (110) reflects its sided sheave is pulling from corresponding strut (108), indicating misalignment of rails; monitoring the fender system (118) of (FIG. 10) to ease bearing against the dock far side and simultaneously bringing fenders to bear more on dock side overriding on aligned position limit.

With submergence of the dock (60), guided by slide means (120) and surrounding pile arrangement, drum of the wire system (109) pays out wires for said sheave (112) to freely hang with the dock; grapple means (122), fixed to the dock engaged with slides (120), controls directional rise of the dock towards bearing with struts (108) and alignment of rails (66).

Figure 10:
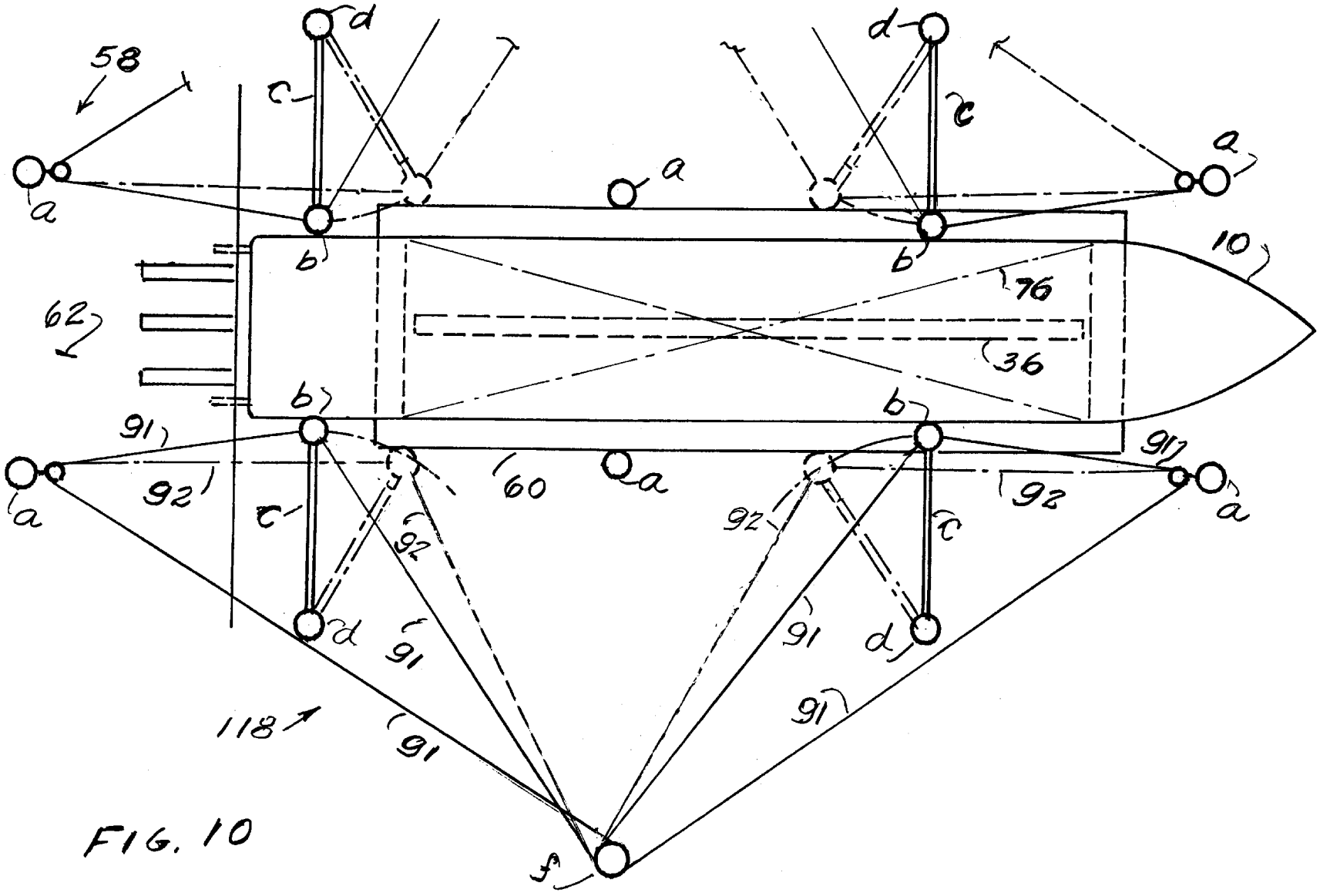
FIG. 10. Diagram of fender system to align surfaced vessel above an immersed dock.
Figures 11A, 11B:
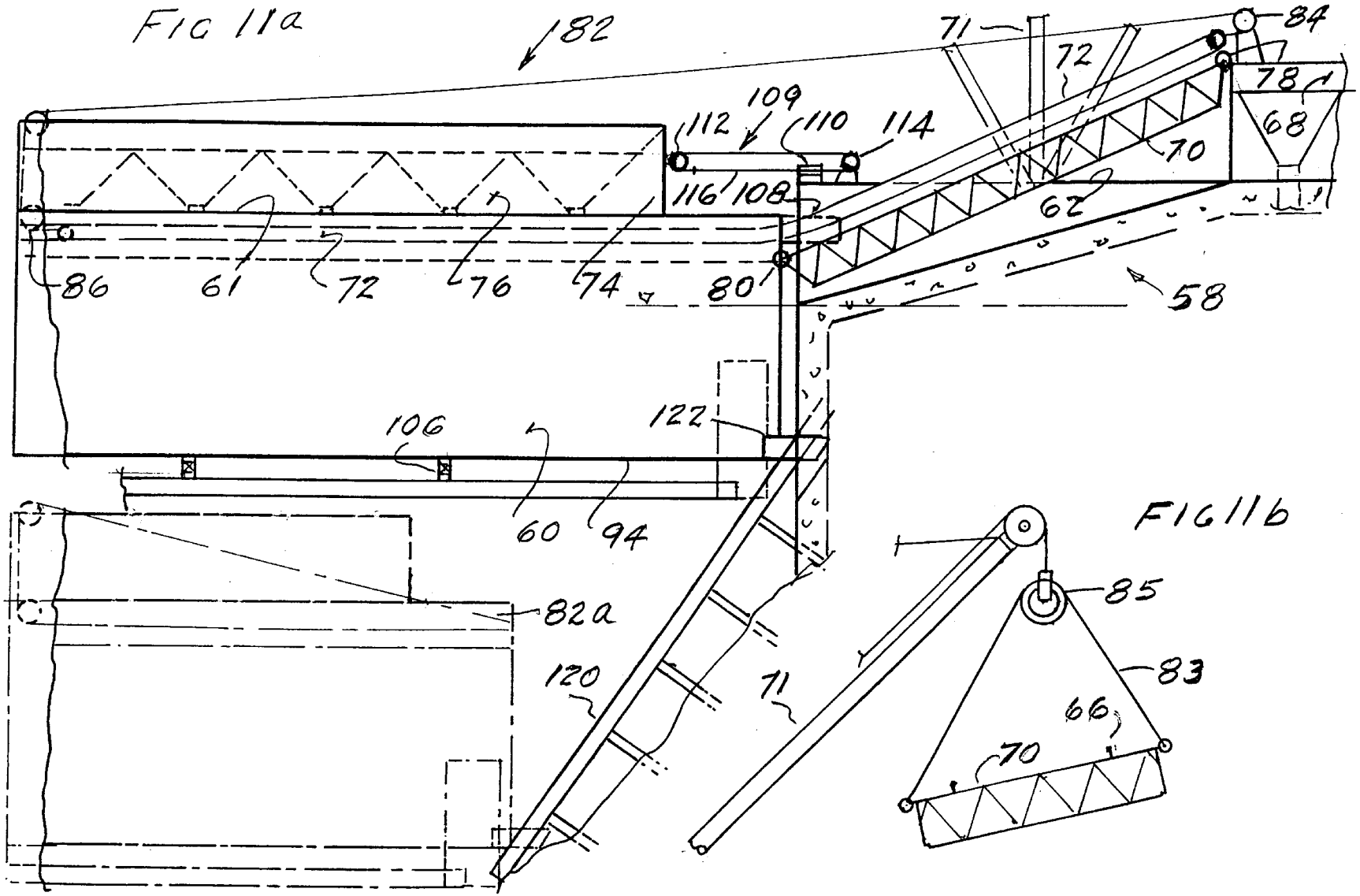
FIG. 11*a*. Side elevational view of the surface docks as displaced above the prior immersed positions.
FIG 11*b*. Diagram of hoist supported apron end response with dock roll.

FIG. 10, fender system 118 tabulation:

59*a*=a=pylon

59*b*=b=buoyant fender

59*c*=c=buoyant stifflag

59*d*=d=plyon centered buoyant ring

59*e*=e=float

59*f*=f=pylon setting of float to house powered drums

59*g*=g=buoyant rope.

59*f* is an encapsulated motor assembly with a vertical shaft, key mounting dual drums. Motor C W turns one drum fitted to haul on two ropes (g1) to set fender (b) to bear with vessel (10). Motor CCW turns the other drum to haul on one rope (g2) to open the system for fender (b) to bear with the dock (60).

h.) Adjacent bucket corners, for each of eight formed by partitioning the bucket (16), are conventional toggle-joint (45) fitted, arranged (FIG. 12) in space (34) below the deep deck (32*a*) and contained at bucket spaced-apart 40 to clear opening of bucket halves. Toggles are remote controlled by conventional hydraulic thrusters (47) set in a slit 46*s*, in webbing of girders 46*a*, to also locate reinforcing bracket 49 extending up in fix to the deep deck. Pivotally mounted compression members 49*a*, off said adjacent corners, as linked 49*b* to thrustors 47, hang vertical; and when links 49*b* align, they center rest upon said webbing, to lock the arrangement (45) against bucket sway at sea.

i.) The hinged type lock (44) (FIG. 7), integrally leveraged, is clamped to a toggle joint arrangement; with linkage members 44*b* aligned, effecting columnal solidity. Remotely controlled conventional hydraulic thruster (44*c*), benefiting form mechanical advantages of both said toggle joint and leverage, selectively acts to lock together cargo halves of clamshell buckets (16), closed by hydraulic cylinder 42. Opened lock, clamshell halves are spread open by the hydraulic cylinder to self-discharge contained slurry.

j.) Specifics noted, for example, to more simply detail arrangements, are not intended as limiting values. For example, the integral clamshell bucket may as well as portioned to more or less than five parts.

k.) Sizing. The fleet of vessels needed determines the vessel (10) dead weight cargo capacity and vessel corresponding size in overall breadth B, length L, and depth D. The hollowed-out hull mid-length (12) is enclosed by conventional entrance forebody **(10*f*) and run afterbody (10*a*). Longitudinal frame constructed as cross braced includes extensive partitioning (11)** of the hull midlength.

Modular constructed hull segments determine bulkhead spacing (FIGS. 1, 2, 3); and, this horizontal partitioning **(11*a*) is divided into at least two elevational tiered partitions (11*b*) beneath said deep deck (32*a*) which has isolated wing partitioning (11*c*). Isolated compartments (19), by partitions (11*a, b, c*) are selectively fitted with remote controlled valves as piped to a vertical shaft, unit assembled (17), pump and encapsulated motor for ballast feed to selected compartments (19), radio remote controlled from the tug in tow of the unmanned vessel (10)**.

Selected compartment (19), ballasting to moderate rolling of the vessel from sea vicissitudes, provides reserve buoyancy for optimal vessel draft ($T_2$) at sea and least draft ($T_1$) in sheltered coves with approach to a mooring above a said submerged dock.

Isolated run afterbody **(10*a*) contains a diesel-generator set (13) and the ballast pump motor (17)**. Generator and motor are encapsulated for containment in a nitrogen gas environment to eliminate marine atmospheric corrosiveness. Batteries, charged by said generator, serve continual demand of auxiliary equipment, notably lights to code.

SUMMARY

Novelty, in marine transporting a selected species of bulk cargo, permits liberties in hauling cargo, with kind termed gravel as immersed, yielding definite gains. Said liberty comprising the containment of gravel as a slurry by a clamshell bucket (16), made porous. Hinge mounted said bucket, with axis (14) common to scribbing the bucket semi-cylindrical form (18), fits with a gap within a conforming hollowed-out (12) mid-length $L_p$ of the vessel (10); unhindering to peel open the bucket to discharge slurry through a slotted vessel bottom opening (36).

Now said terminal's accommodation is a critical part towards realizing said gain. To suit; a fender system (118) provides guidance of said vessel (10) to moor above a suitably positioned dock (60) having submerged while bearing on a slide (120) and within encircling piling. System (118) spreads open upon departure of the vessel (10) to contain a surfaced dock (60), raised by controlled removal of ballast water from a conglomerate of chambers (88) partitioning the air vented dock hold.

The surfaced dock, with deck (61) arranged porous hoppers (76), loaded with gravel, drained of sea water (60), is in aligned position with the terminal arranged belt conveyor system (72); made mobile to more on/off the dock via an apron (70) hinged to a bridge (68), the bridge extending over said grade area (62), and apron hoisted end let to bear on the dock, the apron compensating for tidal and load change.

Remote control monitors gravel feed from hoppers to conveyors, suiting loading any one of the three differently, consistent with maintaining a level dock. Conveyors (72), withdrawn for the dock (60) to submerge, are parked on said bridge (68); erected to provide terminal thoroughfare beneath the three so as not to disrupt traffic, the four or five hours with the dock submerged, when activity is at a peak to service apparatus after each thirty hour use.

Powered wire means to pull-haul conveyors on/off the dock are made separable into dock and apron draped portions for the dock to submerge.

More as a binder, secondarily as a tethering of the dock to the grade area, are two tensioned wire systems (109) connected to dock (60) corners abutting spring loaded struts (108). A powered drum (114), fixed to the grade area (62), pays out a steel wire to a sheave (112) shackled to the dock (60) corner, with wire reeved end connected to a nylon rope (116) with length extended for connection to a tensiometer (110) fixed with said drum.

Either tensiometer measures an increased nylon rope tension. Nylon rope (116) resilience suits the horizontal component change as said apron (70) angularity varies with tidal and load change. Said either rope increased tension, reflecting that dock end pull from the strut (108), warns the far end of the dock has encroached an alignment limit.

Increased one rope tension monitors the fender system (118), causing one fender side to ease off as the other fender side adds bearing, to push back the dock end for an aligned conveyor (72). Conveyors are fitted with conventional belt training means, more aptly used with a non-rigid mounting of a long belt.

With submergence of the dock said drum (114) pays out wire so the shackle mounted sheave (112) hang with slack wire reeving therewith. The two dock sided wires do not serve as elevators but may be tensioned in emergency observing the nylon rope portion remains at grade area.

What I claimed is:

1. In a combination providing marine vessel transportation of slurry-type cargo, the improvement comprising:

(a) a shipshaped vessel fitted with a hollowed out mid-length portion buoyantly supporting the pivotal mounting of hinged halves of a clamshell bucket slurry carrier disposed in said hollowed-out portion wherein said vessel is gradually loaded until the axes of the hinged mounting lies in proximity with and below the water surface;

(b) said clamshell bucket halves including serrated surfaces lying in abutment with each other when locked and defining gaps that permit the free passage of water but prevent the loss of slurry;

(c) the pivotal axis of the clamshell bucket halves being coaxial with the axis of the arc scribing the semi-cylindrical arc of the exterior surface of the clamshell halves and with the axis of the scribing arc of the hollowed portion;

(d) the clamshell halves are limited in angular pivoting about the common pivotal axis as needed to self discharge the slurry from the bucket sloping wall;

(e) the semi-cylindrical clamshell bucket comprises at least two separately built buckets spaced apart to distribute the load weight to supporting members of the vessel, to permit the positioning of hydraulic-cylinders designed to open and close the halves;

(f) the semi-cylindrical clamshell halves are constructed with a hollow interior to provide a buoyant force;

(g) the clamshell buckets are provided within holds in the vessel with each hold including dual hatchways through the vessel deck fitted with a vertical cylindrical spout to disrupt the free fall of slurry being loaded by intercepting sloping interior shelves;

(h) the loaded vessel destination is to a coastwise terminal grade area, sited in a cove to harbor an elongated floating dock, lengthwise stayed from the terminal concreted face, for vertical immersion as ballasted or water surfaced upon pump ejection of water ballast, the immersed dock deck mirrors said vessel moored directly above, depending on piling and fenders for a vertical alignment of their longitudinals;

(i) longitudinally the dock deck supports at least one length of joined together porous hoppers, below deck the center of each said length also centers a full length steel enclosing tunnel with tracks, that with the dock surfaced, align with a like set of tracks borne by a bridge erected from the grade area, and align with rails on an apron hinged to the bridge, the apron, depending upon the dock for end support, accommodates load and tidal differences of dock level with the grade area;

(j) typical rubber belt conveyor assemblies, mounted on wheels to run on said rails, are powered off the dock to said bridge before the dock is submerged, operated conveyors on the water surfaced dock discharge gravel, free of water drained from surfaced porous hoppers, into chutes completing said transportation;

(k) hoppers arranged on the dock deck, surrounded by a bulwark, self-feed gravel to center fixed gates remotely opened selectively to feed gravel onto conveyors in said tunnels;

(l) a multiple arrangement of powered wire rope systems individually provide: an operative fender system bearing with the presently disposed water surfaced dock or vessel, another means to pull propel conveyors on/off the dock, and a dual monitoring means for alignment of the dock held against the face of the terminal.

* * * * *